US007971766B2

(12) United States Patent
Tang

(10) Patent No.: US 7,971,766 B2
(45) **Date of Patent: *Jul. 5, 2011**

(54) SWITCH MECHANISM FOR STAPLERS

(76) Inventor: Jhih-Siang Tang, Taichung (TW)

( * ) Notice: Subject to any disclaimer, the term of this patent is extended or adjusted under 35 U.S.C. 154(b) by 120 days.

This patent is subject to a terminal disclaimer.

(21) Appl. No.: 12/230,185

(22) Filed: Aug. 26, 2008

(65) Prior Publication Data

US 2009/0283566 A1 Nov. 19, 2009

(30) Foreign Application Priority Data

May 16, 2008 (TW) ..... 97118257 A

(51) Int. Cl.
*B25C 5/13* (2006.01)

(52) U.S. Cl. ..... 227/8; 227/130; 227/2

(58) Field of Classification Search ..... 227/8, 120, 227/130, 2, 107

See application file for complete search history.

(56) References Cited

U.S. PATENT DOCUMENTS 2,714,208 A * 8/1955 Jenny ..... 227/128
3,612,379 A * 10/1971 Panock ..... 227/8
3,784,077 A * 1/1974 Burke et al. ..... 227/8
4,629,106 A * 12/1986 Howard et al. ..... 227/8
5,083,694 A * 1/1992 Lemos ..... 227/8
5,137,197 A * 8/1992 Bauer ..... 227/8
5,551,620 A * 9/1996 Vallee ..... 227/8
5,551,621 A * 9/1996 Vallee ..... 227/8
5,692,663 A * 12/1997 Yang ..... 227/8
5,791,545 A * 8/1998 Lin ..... 227/8
5,797,533 A * 8/1998 Lee ..... 227/8
5,836,501 A * 11/1998 Lai ..... 227/8
5,862,969 A * 1/1999 Lee ..... 227/8
6,059,161 A * 5/2000 Chang et al. ..... 227/8
6,116,488 A * 9/2000 Lee ..... 227/8
6,145,727 A * 11/2000 Mukoyama et al. ..... 227/130
6,213,372 B1 * 4/2001 Chen ..... 227/8
6,357,647 B1 * 3/2002 Ou ..... 227/8
6,419,140 B1 * 7/2002 Chen ..... 227/8
6,422,446 B1 * 7/2002 Liu ..... 227/8
6,431,425 B1 * 8/2002 Moorman et al. ..... 227/8
6,450,387 B1 * 9/2002 Chen ..... 227/8
6,543,664 B2 * 4/2003 Wolfberg ..... 227/8
6,588,642 B1 * 7/2003 Wang et al. ..... 227/8
6,659,324 B1 * 12/2003 Liu ..... 227/8
6,857,547 B1 * 2/2005 Lee ..... 227/8
6,860,416 B1 * 3/2005 Chen ..... 227/8
6,886,729 B1 * 5/2005 Lee ..... 227/8
6,948,646 B2 * 9/2005 Huang ..... 227/8
6,953,137 B2 * 10/2005 Nakano et al. ..... 227/8

(Continued)

*Primary Examiner* — Lindsay Low

(74) *Attorney, Agent, or Firm* — Raymond Y. Chan; David and Raymond Patent Firm

(57) ABSTRACT

A switch mechanism for a stapler includes a trigger, a pivotable member, and a swing member, which is pivotably connected to the trigger by two pins. The pivotable member has a first protrusion extending from a top of the pivotable member. The pivotable member is received in a recess of the slide member and a second protrusion extends from an inner top end thereof A spring is connected between the first and second protrusions so that the slide member is movable relative to the pivotable member. The swing member includes a first curved part and a second curved part which is located at a side of the pivotable member. The curved part of the swing member is inserted into a hole of the slide member when pulling the trigger, and the slide member is moved downward to change the relative position between the slide member and the valve of the stapler.

20 Claims, 11 Drawing Sheets

U.S. PATENT DOCUMENTS

| | | | | |
|---|---|---|---|---|
| 7,070,080 | B2 * | 7/2006 | Lin | 227/8 |
| 7,073,697 | B2 * | 7/2006 | Lin | 227/8 |
| 7,143,918 | B2 * | 12/2006 | Aguirre et al. | 227/8 |
| 7,152,773 | B2 * | 12/2006 | Ke | 227/8 |
| 7,308,995 | B2 * | 12/2007 | Uchiyama et al. | 227/8 |
| 7,314,154 | B2 * | 1/2008 | Huang et al. | 227/8 |
| 7,322,426 | B2 * | 1/2008 | Aguirre et al. | 173/1 |
| 7,458,492 | B2 * | 12/2008 | Terrell et al. | 227/8 |
| 7,464,843 | B2 * | 12/2008 | Huang | 227/8 |
| 7,635,072 | B2 * | 12/2009 | Bo-Seob et al. | 227/8 |
| 2002/0056739 | A1 * | 5/2002 | Liu | 227/8 |
| 2002/0130154 | A1 * | 9/2002 | Wolfberg | 227/8 |
| 2005/0001001 | A1 * | 1/2005 | Nakano et al. | 227/8 |
| 2005/0023318 | A1 * | 2/2005 | Aguirre et al. | 227/8 |
| 2005/0139628 | A1 * | 6/2005 | Aguirre et al. | 227/8 |
| 2006/0027621 | A1 * | 2/2006 | Lin | 227/8 |
| 2006/0032885 | A1 * | 2/2006 | Lin | 227/8 |
| 2006/0213945 | A1 * | 9/2006 | Ke | 227/8 |
| 2006/0255086 | A1 * | 11/2006 | Aguirre et al. | 227/8 |
| 2007/0034660 | A1 * | 2/2007 | Terrell et al. | 227/8 |
| 2007/0125822 | A1 * | 6/2007 | Liu | 227/8 |
| 2008/0185415 | A1 * | 8/2008 | Huang | 227/8 |
| 2009/0108046 | A1 * | 4/2009 | Huang | 227/8 |
| 2009/0283566 | A1 * | 11/2009 | Tang | 227/8 |
| 2009/0314818 | A1 * | 12/2009 | Segura | 227/8 |
| 2010/0012700 | A1 * | 1/2010 | Perron et al. | 227/8 |

* cited by examiner

SWITCH MECHANISM FOR STAPLERS

FIELD OF THE INVENTION

The present invention relates to a stapler, and more particularly, to a switch mechanism for switching single-shoot and continuous-shoot modes.

BACKGROUND OF THE INVENTION

A conventional switch mechanism for a stapler generally includes a window in the trigger and the window is located corresponding to the safety rod. An eccentric rod is pivotably connected to the trigger and a top plate is connected to the eccentric rod, the top plate has stepped surface which is located outside of the window. The relative position between the stepped surface of the top plate and the safety rod can be adjusted by operation of the eccentric rod. However, when the eccentric rod is located beneath a hole in the trigger, the eccentric rod might be moved upward and/or shakes due to vibration when operating the stapler. There lacks a suitable locking means to set the position of the eccentric rod so that the switch mechanism is not reliable.

In order to position the eccentric rod, a spring with a significant force is needed, but the spring increases the difficulty to the user to operate the eccentric rod.

The present invention intends to provide a reliable switch mechanism which can switch the single-shoot mode and the continuous-shoot mode of the stapler.

SUMMARY OF THE INVENTION

The present invention relates to a switch mechanism for a stapler and the switch mechanism comprises a trigger composed of two sidewalls and a closed bottom. A pivotable member is pivotably connected to the trigger and a first protrusion extends from a top of the pivotable member. A slide member has a recess defined in a side thereof and the recess communicates with an open bottom of the slide member. A second protrusion extends from a top inner end of the slide member. A spring is connected between the first and second protrusions. A portion of the pivotable member is received in the recess and the slide member is movable relative to the pivotable member. A swing member is pivotably connected to the trigger and has a first curved part and a second curved part. The second curved part is located at a side of the pivotable member. A torsion spring is connected between the swing member and the trigger.

The primary object of the present invention is to provide a switch mechanism for switching single-shoot mode and continuous-shoot mode by reversing the sequence of pressing the trigger and the safety rod.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
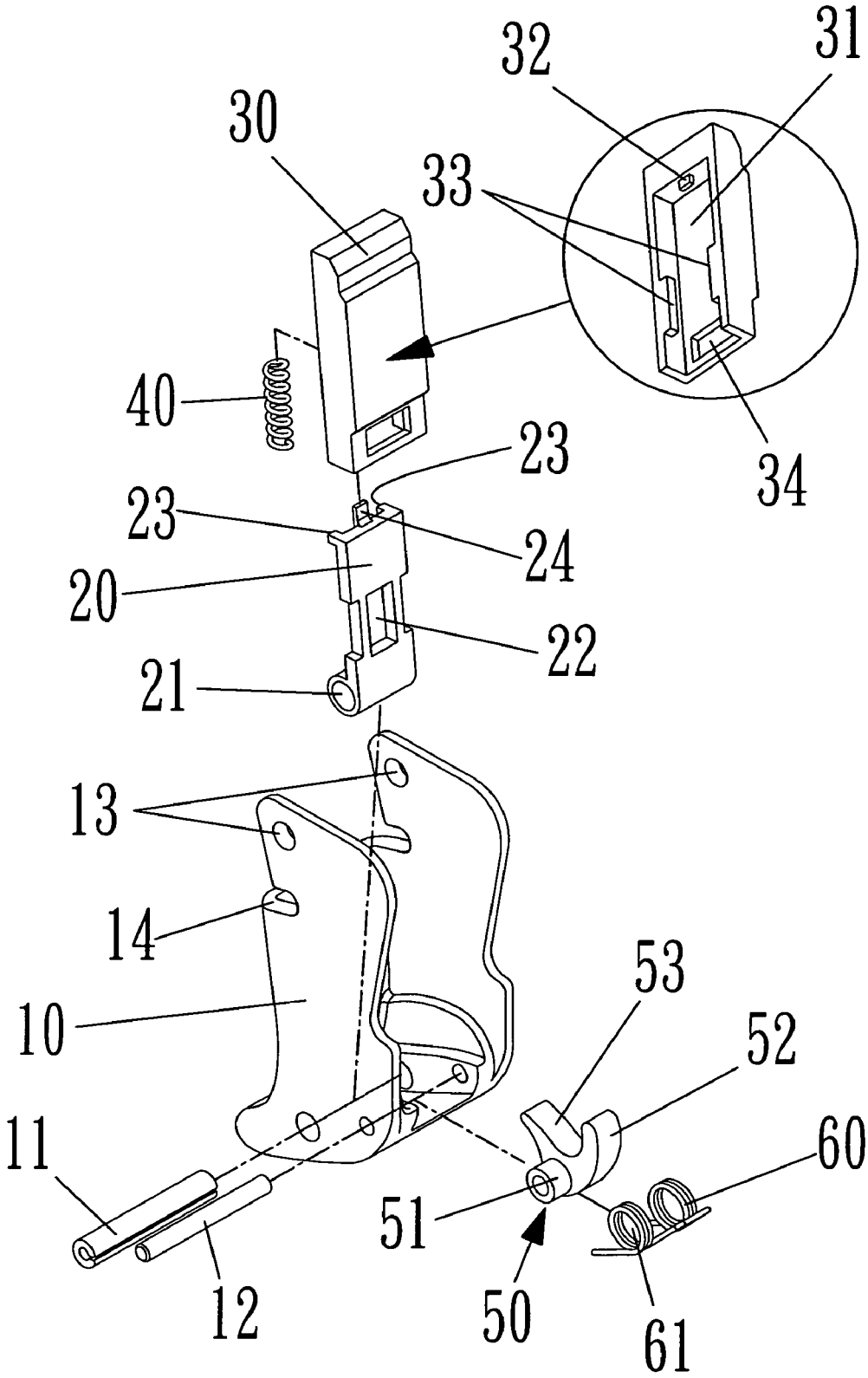
FIG. 1 is an exploded view to show the switch mechanism of the present invention and the stapler cooperated with the switch mechanism.
Figure 2:
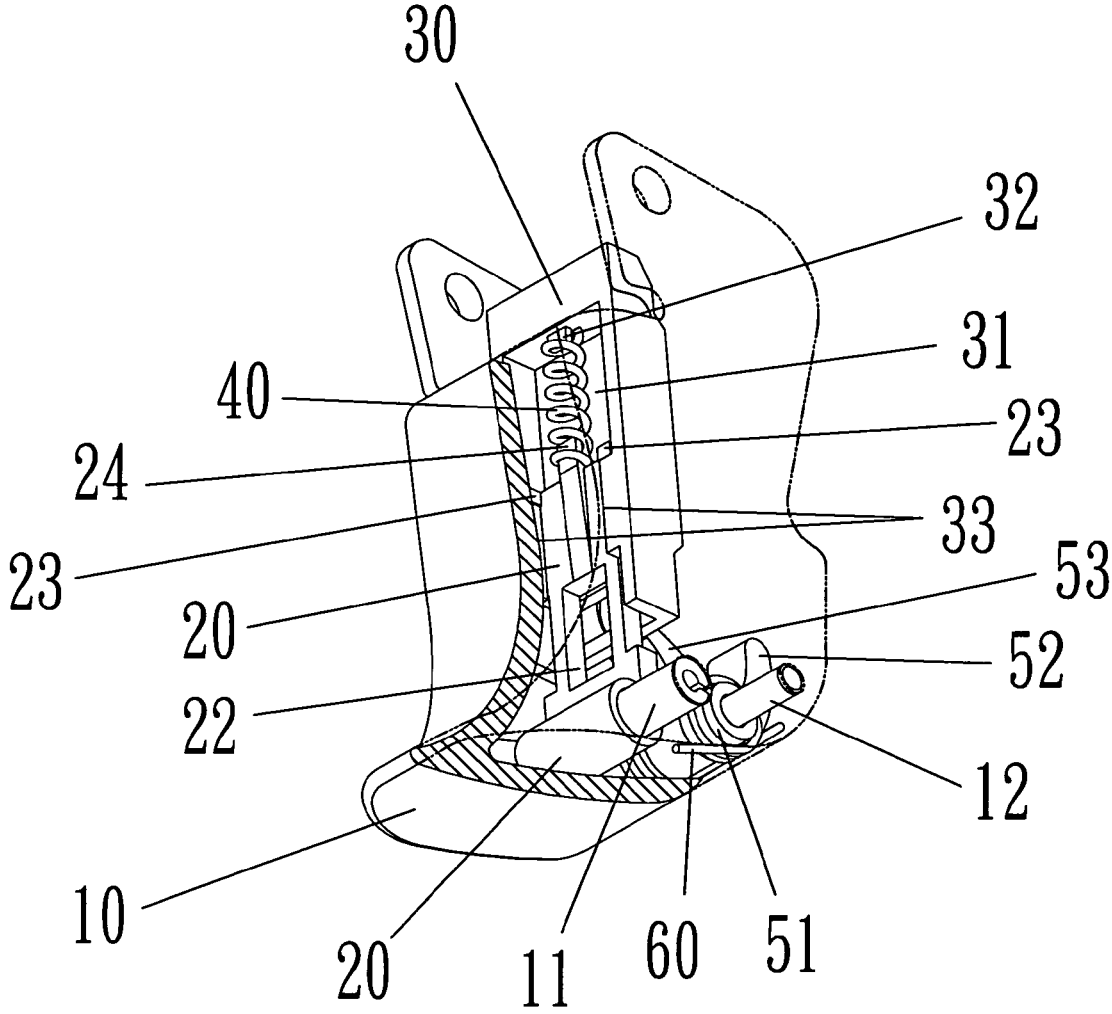
FIG. 2 is a perspective view, partly removed, to show the switch mechanism of the present invention.
Figure 3:
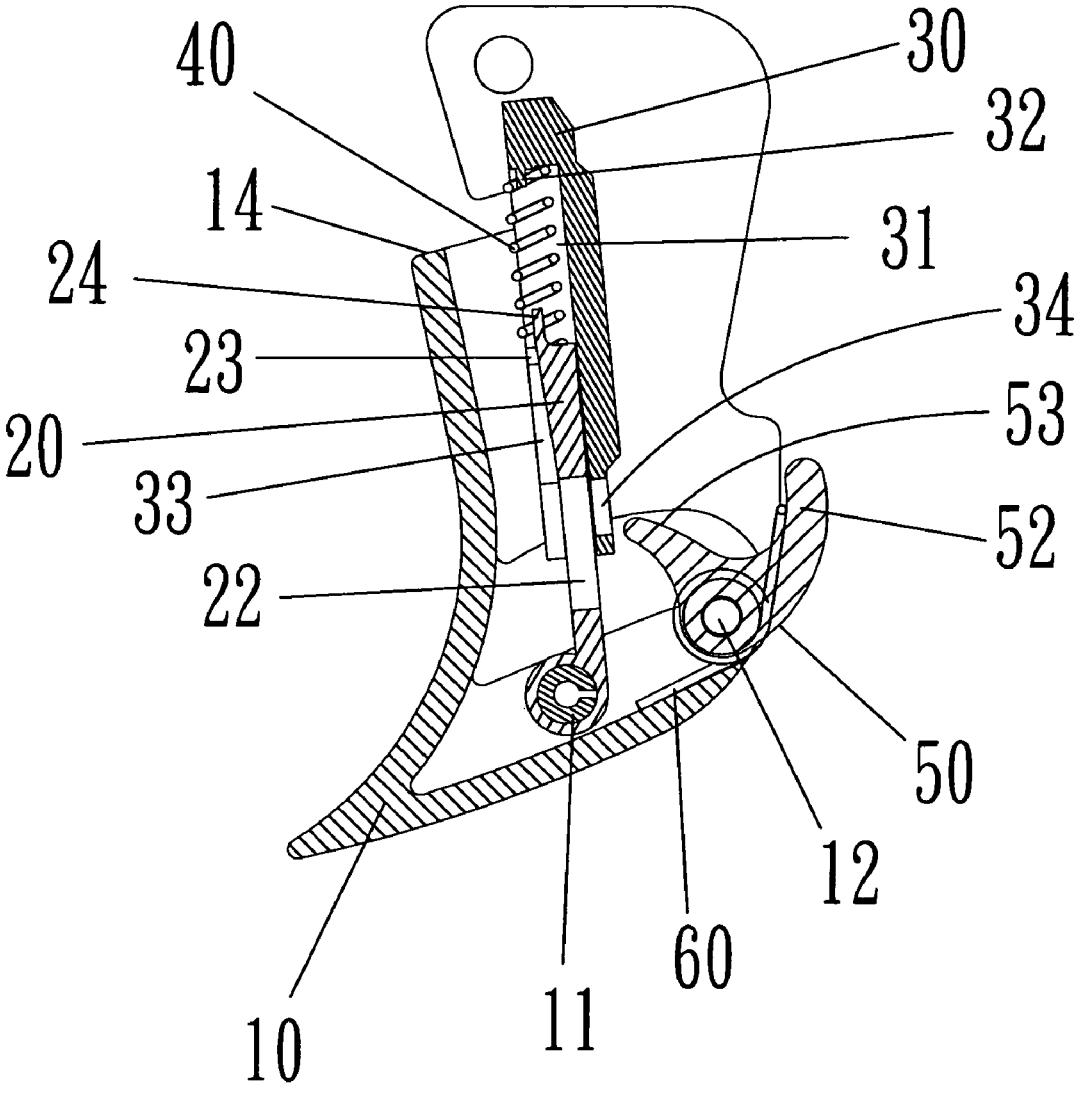
FIG. 3 is a side cross sectional view of the switch mechanism of the present invention.
Figure 4:
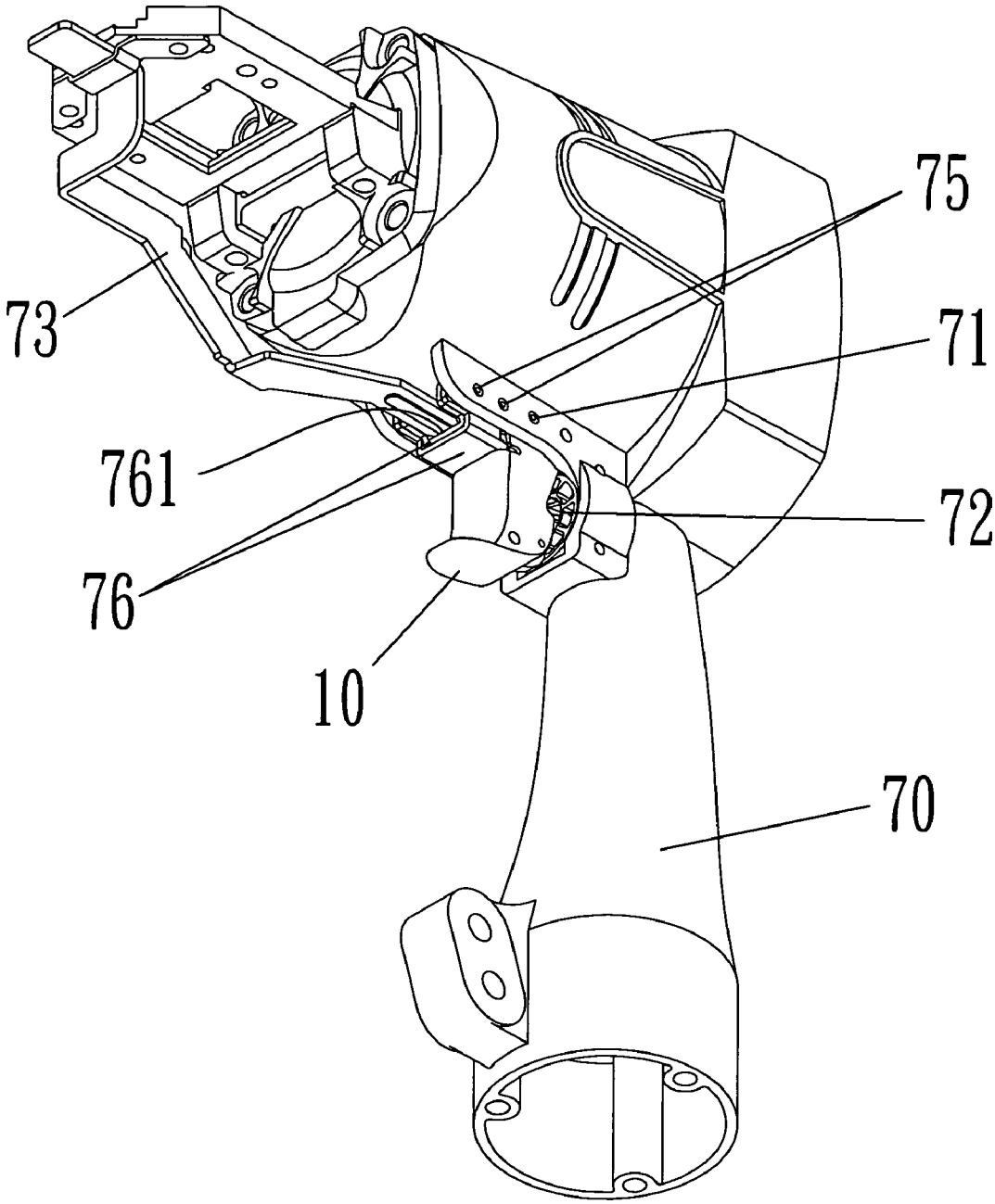
FIG. 4 is a perspective view to show that the switch mechanism of the present invention is connected to a stapler.
Figure 5:
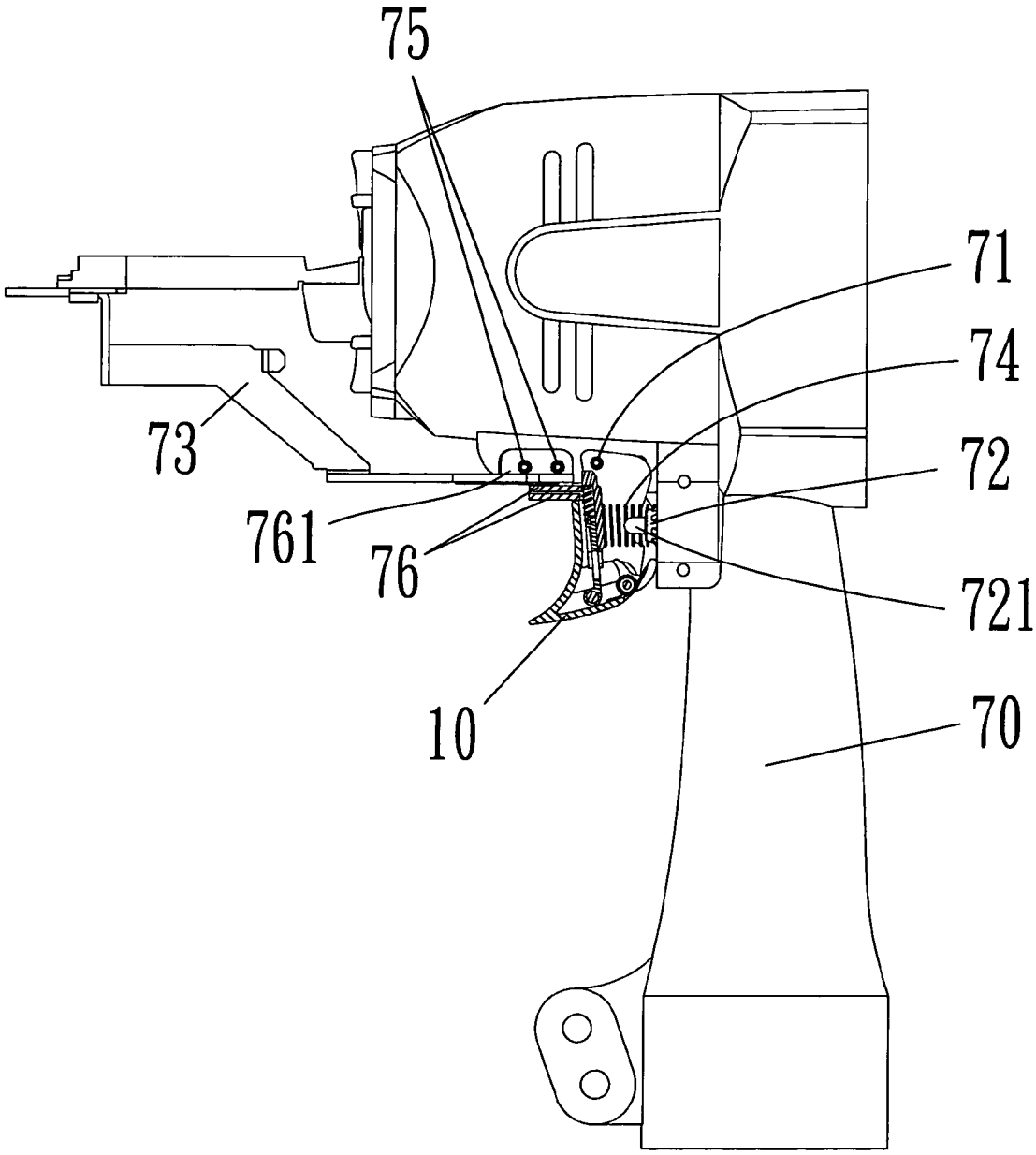
FIG. 5 is a cross sectional view to show that the switch mechanism of the present invention is not yet pulled.
Figure 6:
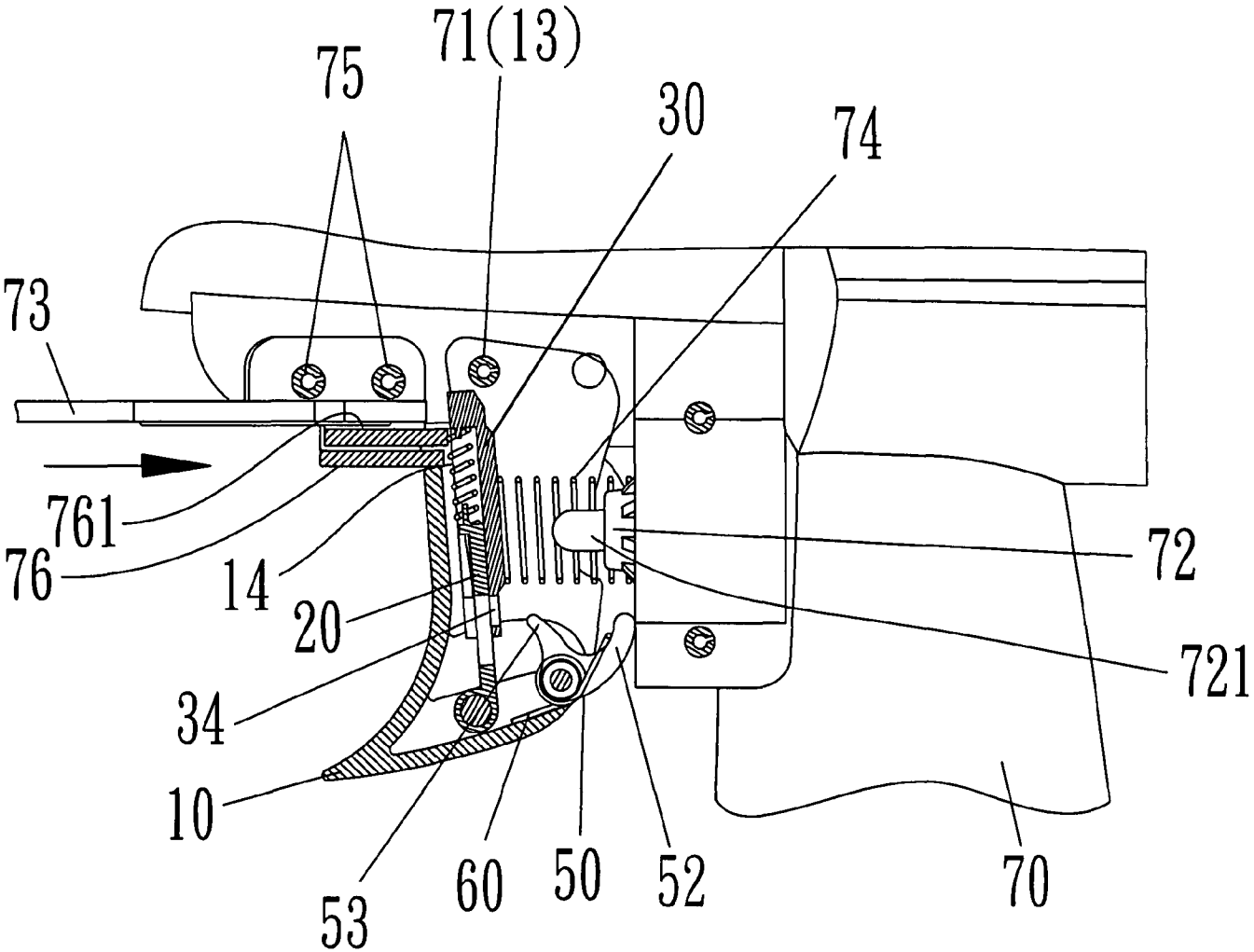
FIG. 6 is a partial cross sectional view to show the first step when performing the single-shoot mode.

Referring to FIGS. 1 to 5, the switch mechanism of the present invention for a stapler comprises a trigger 10, a pivotable member 20, a slide member 30, a spring 40, a swing member 50 and a torsion spring 60. The trigger 10 is composed of two sidewalls, an open top, a closed front side, an open rear side and a closed bottom. The pivotable member 20, the slide member 30, the swing member 50 and the torsion spring 60 are received between the two sidewalls of the trigger 10. A first pin 11 and a second pin 12 are connected between the two sidewalls and located at a lower end of the trigger 10. Two pivot holes 13 are defined through the two sidewalls and located close to a top end of the trigger 10 so that the trigger 10 is pivotably connected to the barrel of the stapler 70 by a pin 71. Two notches 14 are defined in two respective outsides of the two sidewalls of the trigger 10 and a guide plate 76 on the barrel of the stapler 70 is inserted in the notches 14 so as to ensure that the trigger 10 moves along the guide plate 76.

The pivotable member 20 has a pivot hole 21 defined in a lower end thereof and the first pin 11 extends through the two sidewalls of the trigger 10 and the pivot hole 21, so that the pivotable member 20 is pivotably connected to the trigger 10. A first protrusion 24 extends from a top of the pivotable member 20. A window 22 is defined through a mediate portion of the pivotable member 20. Two stops 23 extend from two sides of the pivotable member 20.

The slide member 30 has a recess 31 defined in a side thereof and the recess 31 communicates with an open bottom of the slide member 30. A second protrusion 32 extends from a top inner end of the slide member 30 and a spring 40 is connected between the first and second protrusions 24, 32. A portion of the pivotable member 20 is received in the recess 31 and the slide member 30 is movable relative to the pivotable member 20. Two ribs 33 extend from two sides of the slide member 30 and the two stops 23 are located on two respective top ends of the ribs 33.

The swing member 50 includes a transverse tube 51 and the second pin 12 extends through the transverse tube 51 so that the swing member 50 is pivotably connected to the second pin 12. The swing member 50 includes a first curved part 52 and a second curved part 53 extending therefrom. The second curved part 53 is located at a side of the pivotable member 20 and the second curved part 53 of the swing member 50 is removably inserted into the window 22. The torsion spring 60 includes a ring portion 61 with which the transverse tube 51 of the swing member 50 is engaged. The torsion spring 60 is mounted to the second pin 12 and has a first end contacting the swing member 50 and a second end of the torsion spring 60 contacts the closed bottom of the trigger 10 and located at a side of the second curved part 53 of the swing member 50.

The mediate portion of the slide member 30 is located corresponding to the action rod 721 of the valve 72. A compression spring 74 is connected between the slide member 30 and the valve 72. The guide plate 76 is connected to the barrel of the stapler by two pins 75 and the guide plate 76 includes a groove 761 so that the rear end of the safety rod 73 is located in the groove 761 to move horizontally.

Figure 7:
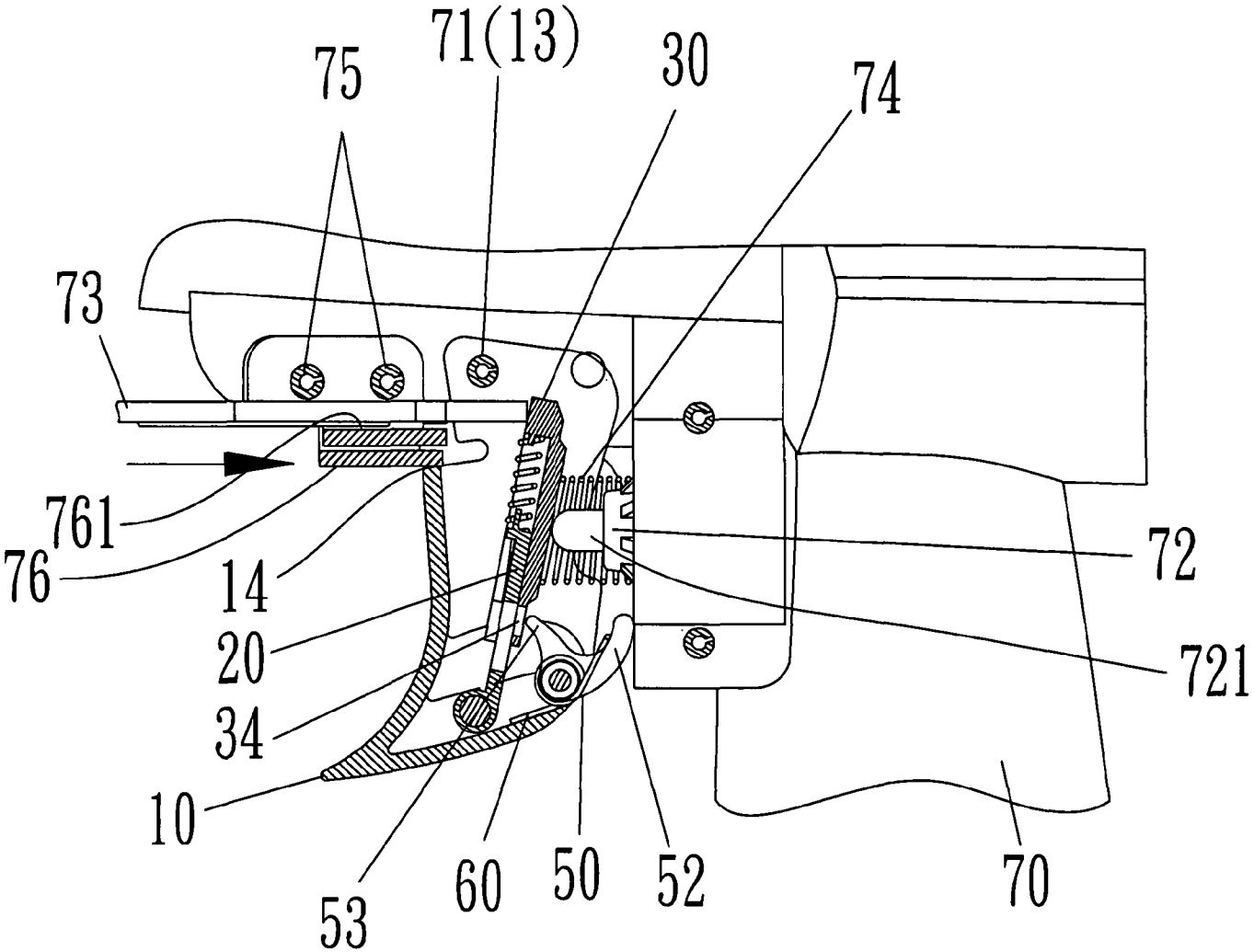
FIG. 7 is a partial cross sectional view to show the second step when performing the single-shoot mode.
Figure 8:
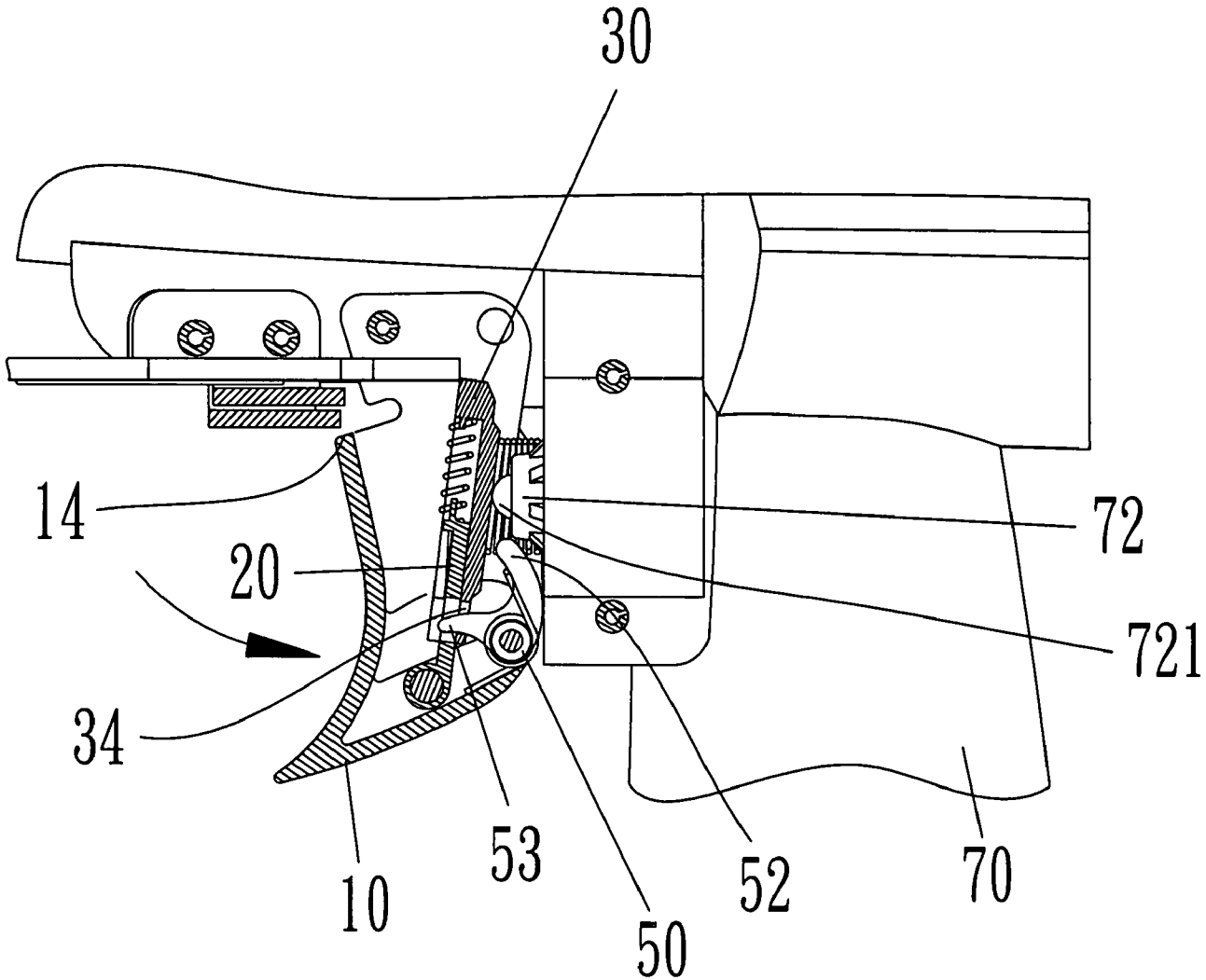
FIG. 8 is a partial cross sectional view to show the third step when performing the single-shoot mode.
Figure 9:
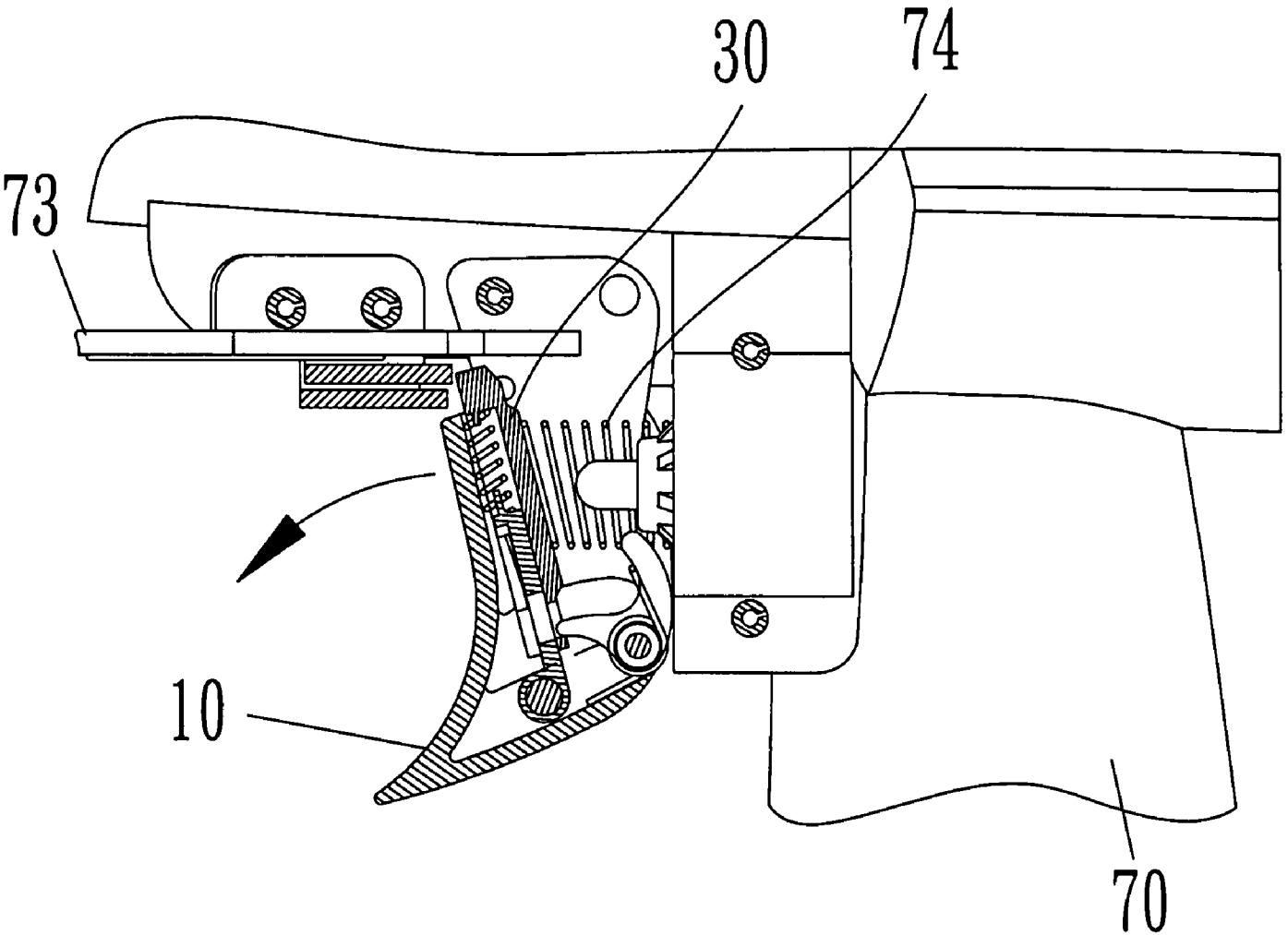
FIG. 9 is a partial cross sectional view to show the fourth step when performing the single-shoot mode.

As shown in FIGS. 6 to 9, when the trigger 10 is not yet pulled, the first curved part 52 of the swing member 50 contacts the handle, and the spring 74 pushes the slide member 30 and the trigger 10 so that the guide plate 76 is engaged with the notches 14. When the safety rod 73 pushes against the object (not shown) to be stapled, the rear end of the safety rod 73 moves into the trigger 10 and pushes the slide member 30 as shown in FIG. 7. The second curved part 53 of the swing member 50 is located corresponding to the through hole 34 of the slide member 30. When pulling the trigger 10 as shown in FIG. 8, the swing member 50 is pivoted and the second curved part 53 is inserted into the through hole 34 and drags the slide member 30 to push the action rod 721 to introduce pressurized air into the barrel. The staple (not shown) is then ejected and the safety rod 73 leaves from the object and the rear end of the safety rod 73 removed from the slide member 30. When the trigger 10 is released, the spring 74 moves the trigger 10 to its original position. This is the single-shoot mode.

Figure 10:
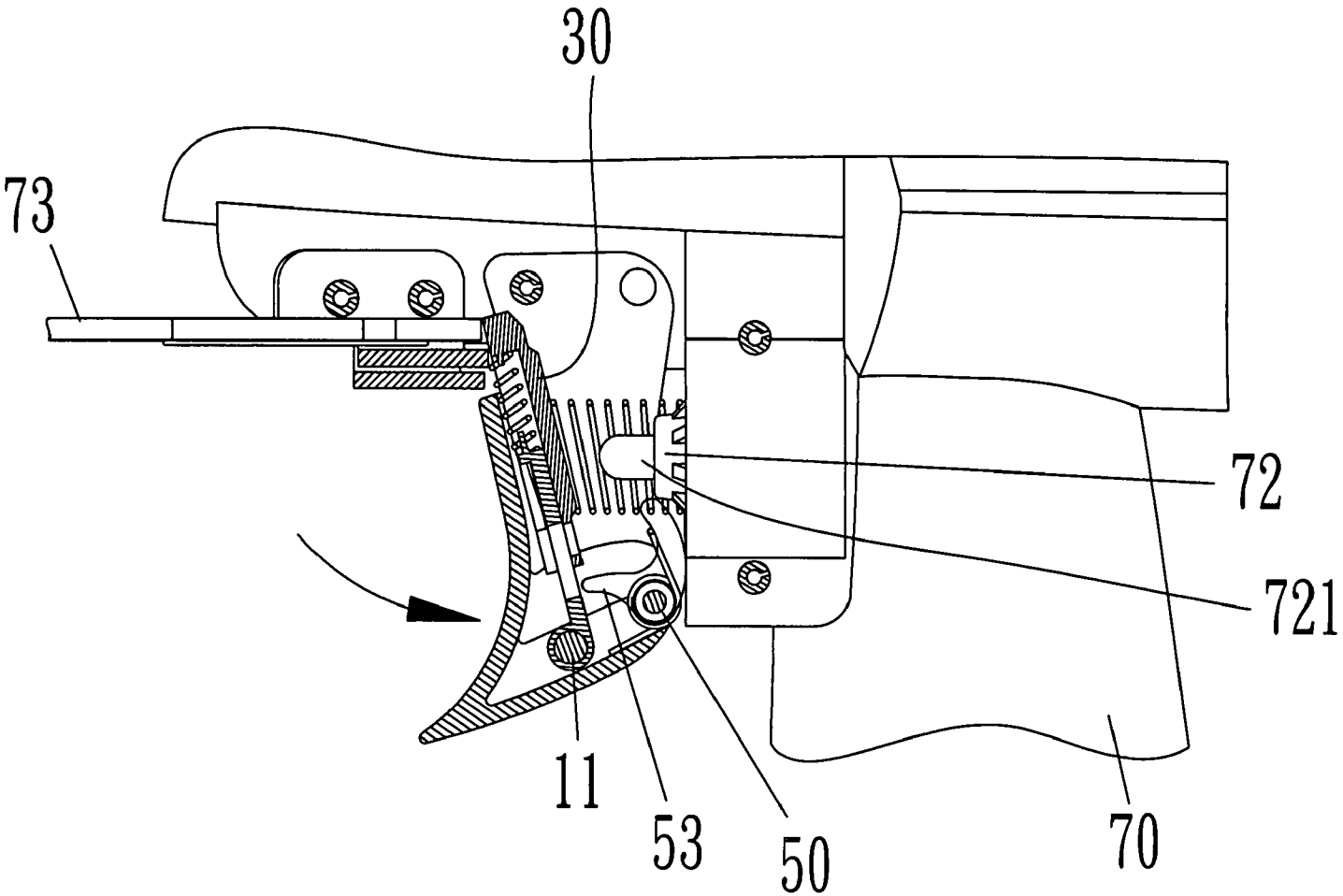
FIG. 10 is a partial cross sectional view to show the first step when performing the continuous-shoot mode.
Figure 11:
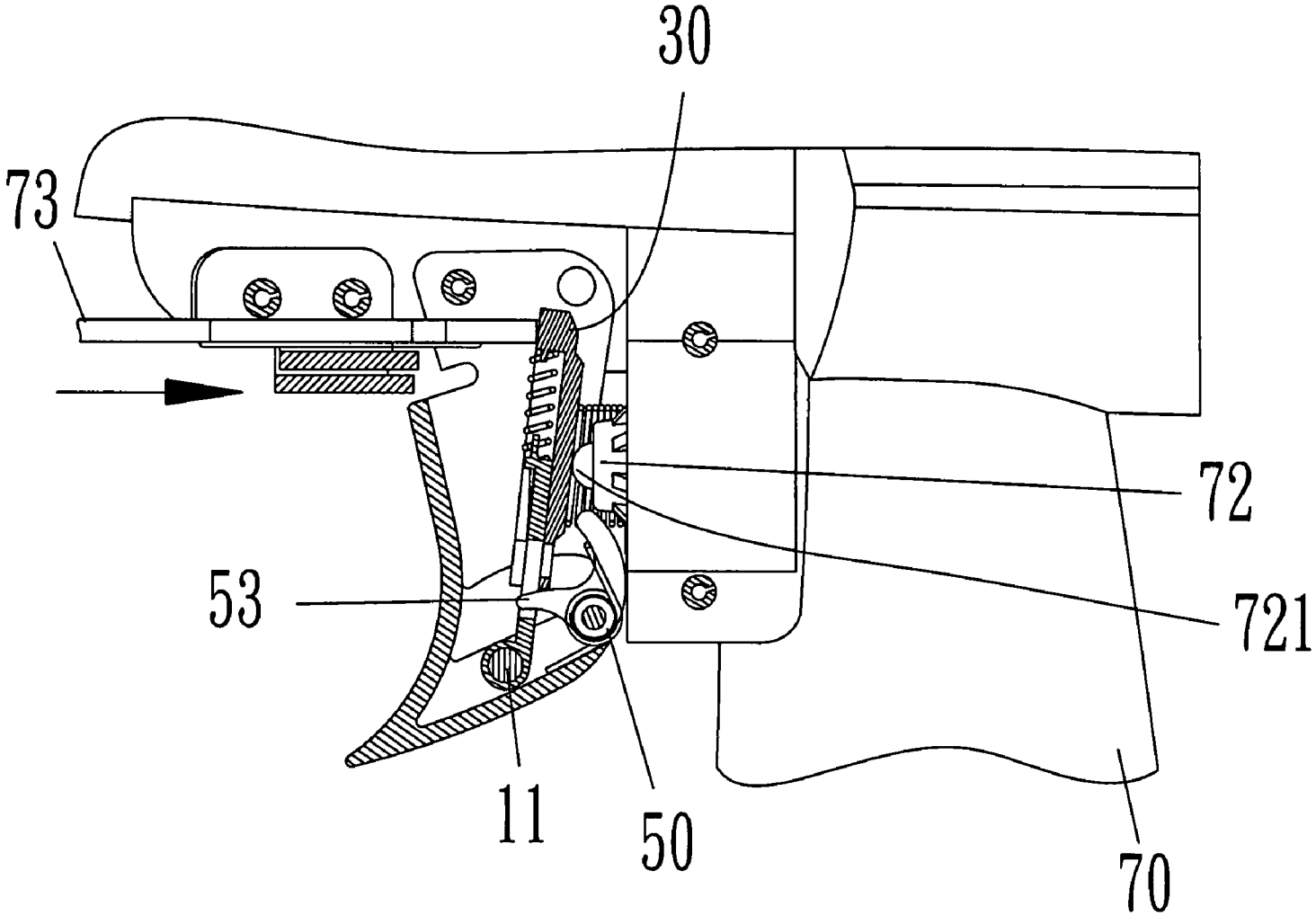
FIG. 11 is a partial cross sectional view to show the second step when performing the continuous-shoot mode.

As shown in FIGS. 10 and 11, if the trigger 10 is pulled before pushing the safety rod 73 against the object, the swing member 50 is rotated and the second curved part 53 is located beneath the slide member 30. When pushing the safety rod 73 against the object, the rear end of the safety rod 73 pushes the slide member 30 to activate the action rod 721 to shoot the staple. When the safety rod 73 leaves from the object and the trigger 10 is not yet released, moving the safety rod 73 to another position can shoot the staples continuously.

While we have shown and described the embodiment in accordance with the present invention, it should be clear to those skilled in the art that further embodiments may be made without departing from the scope of the present invention.

What is claimed is:

1. A switch mechanism for a stapler which includes a barrel with a handle connected thereto, a valve connected to the handle and having an action rod, a safety rod slidably connected to the barrel of the stapler and having a distal end located close to the handle, the switch mechanism comprising:

a trigger composed of two sidewalls and a closed bottom, a first pin and a second pin connected between the two sidewalls and located at a lower end of the trigger, two pivot holes defined through the two sidewalls and located close to a top end of the trigger, two notches defined in two respective outsides of the two sidewalls of the trigger;

a pivotable member pivotably connected to the trigger and a first protrusion extending from a top of the pivotable member, wherein the pivotable member has a pivot hole defined in a lower end thereof and the first pin extends through the two sidewalls of the trigger and the pivot hole;

a slide member having a recess defined in a side thereof and the recess communicating with an open bottom of the slide member, a portion of the pivotable member received in the recess and the slide member movable relative to the pivotable member, a second protrusion extending from a top inner end of the slide member, a spring connected between the first and second protrusions, and a swing member pivotably connected to the second pin and having a first curved part and a second curved part extending therefrom, the second curved part located at a side of the pivotable member, a torsion spring mounted to the second pin and having a first end contacting the swing member, a second end of the torsion spring contacting the closed bottom of the trigger.

2. A switch mechanism for a stapler which includes a barrel with a handle connected thereto, a valve connected to the handle and having an action rod, a safety rod slidably connected to the barrel of the stapler and having a distal end located close to the handle, the switch mechanism comprising:

a trigger composed of two sidewalls and a closed bottom, a first pin and a second pin connected between the two sidewalls and located at a lower end of the trigger, two pivot holes defined through the two sidewalls and located close to a top end of the trigger, two notches defined in two respective outsides of the two sidewalls of the trigger;

a pivotable member pivotably connected to the trigger and a first protrusion extending from a top of the pivotable member;

a slide member having a recess defined in a side thereof and the recess communicating with an open bottom of the slide member, a portion of the pivotable member received in the recess and the slide member movable relative to the pivotable member, a second protrusion extending from a top inner end of the slide member, a spring connected between the first and second protrusions, and a swing member pivotably connected to the second pin and having a first curved part and a second curved part extending therefrom, the second curved part located at a side of the pivotable member, a torsion spring mounted to the second pin and having a first end contacting the swing member, a second end of the torsion spring contacting the closed bottom of the trigger, wherein the pivotable member includes a window defined through a mediate portion thereof and the second curved part of the swing member is removably inserted into the window.

3. The mechanism, as recited in claim 1, wherein the trigger has an open top and an open rear side, the pivotable member, the slide member, the swing member and the torsion spring are received between the two sidewalls of the trigger, wherein the trigger is adapted to be pivotably connected to the barrel of the stapler by a pin.

4. The mechanism, as recited in claim 2, wherein the trigger has an open top and an open rear side, the pivotable member, the slide member, the swing member and the torsion spring are received between the two sidewalls of the trigger, wherein the trigger is adapted to be pivotably connected to the barrel of the stapler by a pin.

5. The mechanism as claimed in claim 2, further comprising two stops extended from two sides of the pivotable member and two ribs extended from two sides of the slide member, wherein the pivotable member is received in the recess of the slide member and the two stops are located on two respective top ends of the ribs.

6. The mechanism as claimed in claim 3, further comprising two stops extended from two sides of the pivotable member and two ribs extended from two sides of the slide member, wherein the pivotable member is received in the recess of the slide member and the two stops are located on two respective top ends of the ribs.

7. The mechanism as claimed in claim 6, wherein the spring is a compression spring.

8. The mechanism as claimed in claim 1, wherein the swing member includes a transverse tube and the second pin extends through the transverse tube.

9. The mechanism as claimed in claim 5, wherein the swing member includes a transverse tube and the second pin extends through the transverse tube.

10. The mechanism as claimed in claim 7, wherein the swing member includes a transverse tube and the second pin extends through the transverse tube.

11. The mechanism as claimed in claim 8, wherein the torsion spring includes a ring portion with which the transverse tube of the swing member is engaged.

12. The mechanism as claimed in claim 9, wherein the torsion spring includes a ring portion with which the transverse tube of the swing member is engaged.

13. The mechanism as claimed in claim 10, wherein the torsion spring includes a ring portion with which the transverse tube of the swing member is engaged.

14. The mechanism as claimed in claim 1, wherein a first end of the torsion spring contacts a side of the second curved part of the swing member and a second end of the torsion spring contacts an inner end of the trigger.

15. The mechanism as claimed in claim 9, wherein a first end of the torsion spring contacts a side of the second curved part of the swing member and a second end of the torsion spring contacts an inner end of the trigger.

16. A switch mechanism for a stapler which includes a barrel with a handle connected thereto, a valve connected to the handle and having an action rod, a safety rod slidably connected to the barrel of the stapler and having a distal end located close to the handle and a guide plate, the switch mechanism comprising:

a trigger composed of two sidewalls and a closed bottom, a first pin and a second pin connected between the two sidewalls and located at a lower end of the trigger, two pivot holes defined through the two sidewalls and located close to a top end of the trigger, two notches defined in two respective outsides of the two sidewalls of the trigger, wherein said guide plate is adapted for inserting into said notches so as to ensure that the trigger moves along the guide plate;

a pivotable member pivotably connected to the trigger and a first protrusion extending from a top of the pivotable member;

a slide member having a through hole, and a recess defined in a side thereof and the recess communicating with an open bottom of the slide member, a portion of the pivotable member received in the recess and the slide member movable relative to the pivotable member, a second protrusion extending from a top inner end of the slide member, a spring connected between the first and second protrusions, and a swing member pivotably connected to the second pin and having a first curved part and a second curved part extending therefrom, the second curved part located at a side of the pivotable member, a torsion spring mounted to the second pin and having a first end contacting the swing member, a second end of the torsion spring contacting the closed bottom of the trigger, wherein the second curved part of the swing member is located corresponding to the through hole of the slide member, whereby said switch mechanism is arranged to switching between a single-shoot mode and a continuous-shoot mode, wherein when the trigger is first pressed and then the safety rod is pressed subsequently, the single-shoot mode is selected, wherein when the safety rod is first pressed and then the safety rod is pressed subsequently, the continuous-shoot mode is selected.

17. The switch mechanism, as recited in claim 16, further comprising a pin adapted for pivotally connecting the trigger to the barrel of the stapler.

18. The switch mechanism, as recited in claim 17, wherein the trigger has an open top and an open rear side, wherein the pivotable member, the slide member, the swing member and the torsion spring are received between the two sidewalls of the trigger.

19. The switch mechanism, as recited in claim 16, wherein the pivotable member includes a window defined through a mediate portion thereof and the second curved part of the swing member is removably inserted into the window.

20. The switch mechanism, as recited in claim 18, wherein the pivotable member includes a window defined through a mediate portion thereof and the second curved part of the swing member is removably inserted into the window.

* * * * *